United States Patent [19]

Heim

[11] 3,986,336

[45] Oct. 19, 1976

[54] IMPROVEMENT IN OR FOR A TORSION PENDULUM CLOCK

[76] Inventor: Egon Heim, 774 Triberg, Sagedobel 30, Germany

[22] Filed: Sept. 3, 1974

[21] Appl. No.: 503,769

[30] Foreign Application Priority Data

Sept. 7, 1973 Germany ..... 2345130

[52] U.S. Cl. ..... 58/131; 58/30

[51] Int. Cl.[2] ..... G04B 17/10

[58] Field of Search ..... 58/129, 29, 30, 31, 58/32, 131; 310/15, 36; 318/123, 130, 128, 132

[56] References Cited

UNITED STATES PATENTS

| | | | |
|---|---|---|---|
| 754,397 | 3/1904 | Tiffany | 58/131 |
| 2,625,787 | 1/1953 | Reiner | 58/30 |
| 3,491,258 | 1/1970 | Siefert | 58/131 X |
| 3,762,155 | 10/1973 | Marble | 58/129 X |
| 3,798,891 | 3/1974 | Sovenyhazi | 58/129 X |

FOREIGN PATENTS OR APPLICATIONS

| | | | |
|---|---|---|---|
| 23,260 | 8/1965 | Austria | 58/131 |
| 1,548,006 | 6/1969 | Germany | 58/30 |

*Primary Examiner*—Ulysses Weldon
*Attorney, Agent, or Firm*—Ulle C. Linton

[57] ABSTRACT

In or for a torsion pendulum clock, a mechanism for limiting the rotation of the torsion pendulum to a predetermined arc to protect the spiral spring.

2 Claims, 4 Drawing Figures

IMPROVEMENT IN OR FOR A TORSION PENDULUM CLOCK

The present invention relates to improvement in or for a torsion pendulum style clock with a pendulum which oscillates without performing any regulating function, the pendulum being driven by a separate drive system housed in a housing and independent of the clock operating mechanism, the rotor spindle of the pendulum being equipped with a spiral spring to generate the rotary pendulum restoring force. Such a clock is shown in Applicants U. S. application for patent Ser. No. 453,358 filed Mar. 21, 1974 now U.S. Pat. No. 3,924,401.

It is already well-known that a torsion pendulum must be suspended from an extremely sensitive pendulum spring the protection of which, however, entails extremely expensive measures (see DT-OS 1 798 274).

In practical operation of such clocks, however, it has been found that if the torsion pendulum is given too vigorous a manual impulse, this spiral spring may be damaged.

The object of the invention, therefore, is to avoid this drawback.

SUMMARY OF THE INVENTION

The present invention provides in or for a rotary pendulum clock, a torsion pendulum drive means for driving said torsion pendulum independent of the clock drive, a housing for the drive means, a rotor spindle of the torsion pendulum, a spiral spring to generate the restoring force of the rotary pendulum and stop means provided to limit the extent of oscillation of the pendulum and hence protect the spiral spring.

Limitation of the arc of oscillation to within 360°, is relatively easy. For decorative reasons, however, the pendulum is required to describe an arc of oscillation of at least 400° and even under these conditions a hard impact at the point of reversal of the motion must be avoided. Therefore, the arc of oscillation is preferably limited to at least 360° up to about 650°, since with an arc of this magnitude there is no risk of any damage to the spiral spring.

In one embodiment, therefore, there is provides a bearing of the rotor, a rotor disc, a stop finger mounted to be freely rotatable on the spindle between the bearing and rotor disc and two stops provided respectively on the rotor disc and housing for engagement by the stop finger.

In another embodiment preferably a toothed drive pinion is carried by the rotor spindle and there is provided a toothed section equipped with stops meching with the toothed drive pinion.

In yet another embodiment, preferably a drive pin is fixed to the rotor, a fork capable of rotation eccentrially with respect to being engageably by the drive pin and stops being provided on the housing for limiting the rotation of the fork.

BRIEF DESCRIPTION OF THE DRAWINGS

Additional advantages and details of the invention will be apparent from the ensuing description of a number of examples given with reference to the drawing where.

DESCRIPTION OF THE PREFERRED EMBODIMENTS

Figure 1:
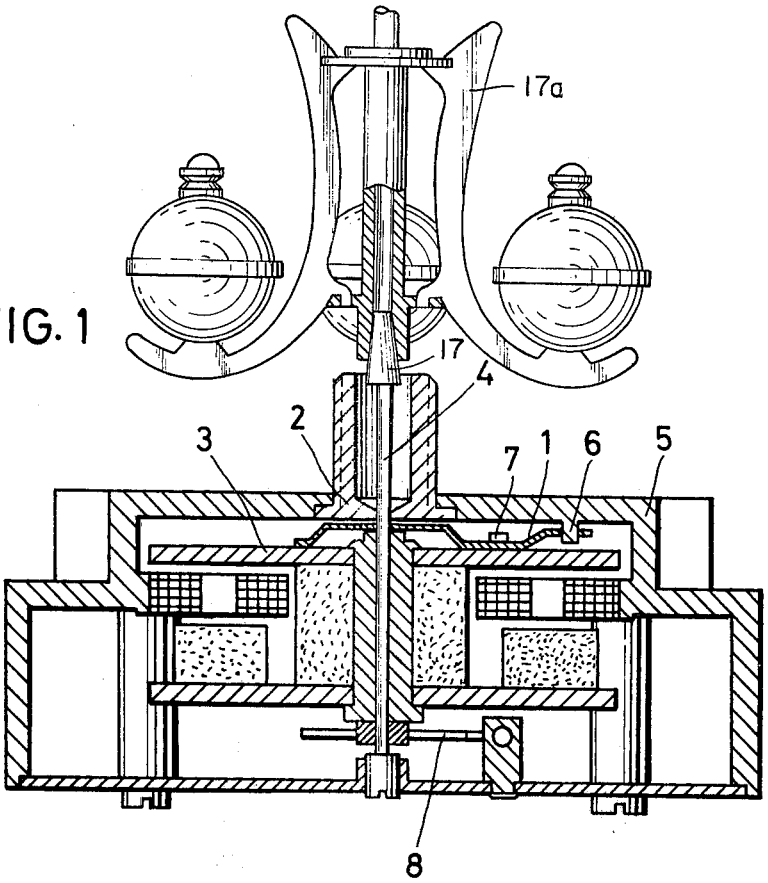
FIG. 1 is a section on the longitudinal vertical axis, of a first embodiment.

FIG. 1 illustrates a housing 5 in which the electrical drive system for the spindle 4 of the torsion pendulum of a torsion pendulum style clock is arranged, said spindle having a coupling 17 upon which a torsion pendulum 17*a* is assembled. The torsion pendulum normally comprises a set of balls which oscillate back and forth about an axis. Such a clock is very attractive but expensive to manufacture if the torsion pendulum regulates the clock and the present mechanism is arranged so as to be separate from the clock mechanism and independently driven. In this way, the attractive appearance of a torsion pendulum clock is retained without great expense, a conventional clockwork mechanism being usable to drive the clock. A spiral spring 8 is shown which produces the restoring force after each rotation of the torsion pendulum with the spindle 4. A rotor disc 3 mounted on the rotor spindle 4, which disc 3 is an element of said electrical drive system for spindle 4, performs rotary oscillations with the spindle 4, i.e. rotates first in one and then in the other direction. In FIG. 1 a stop finger 1 is arranged between the spindle bearing 2 and the rotor disc 3, the stop finger being rotatably mounted on the spindle 4. On the housing 5, a stop dog 6 and on the rotor disc 3 a further stop dog 7, are arranged, see also FIG. 2.

Figure 2:
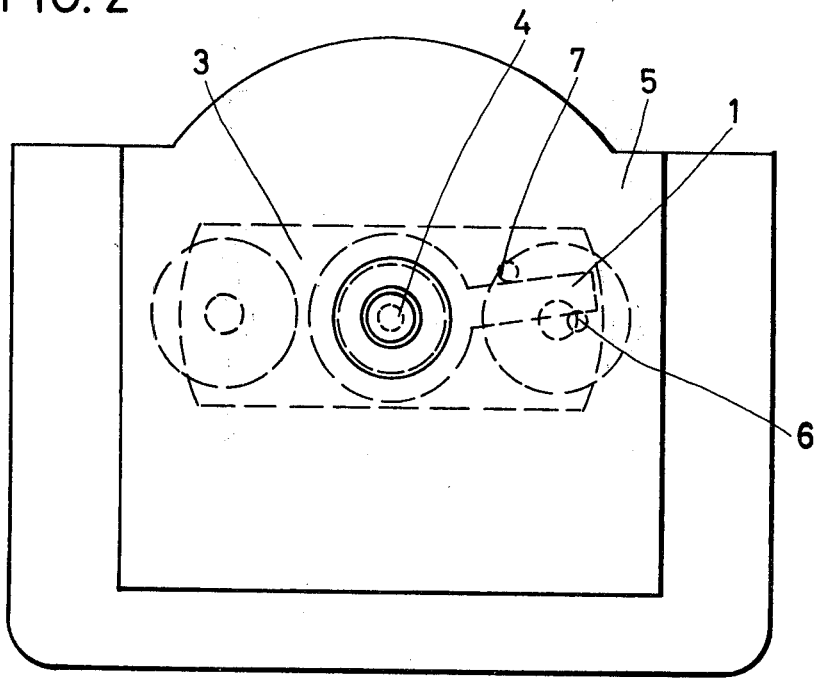
FIG. 2 is a diagramatic plan view on the embodiment shown in FIG. 1.
Figure 3:
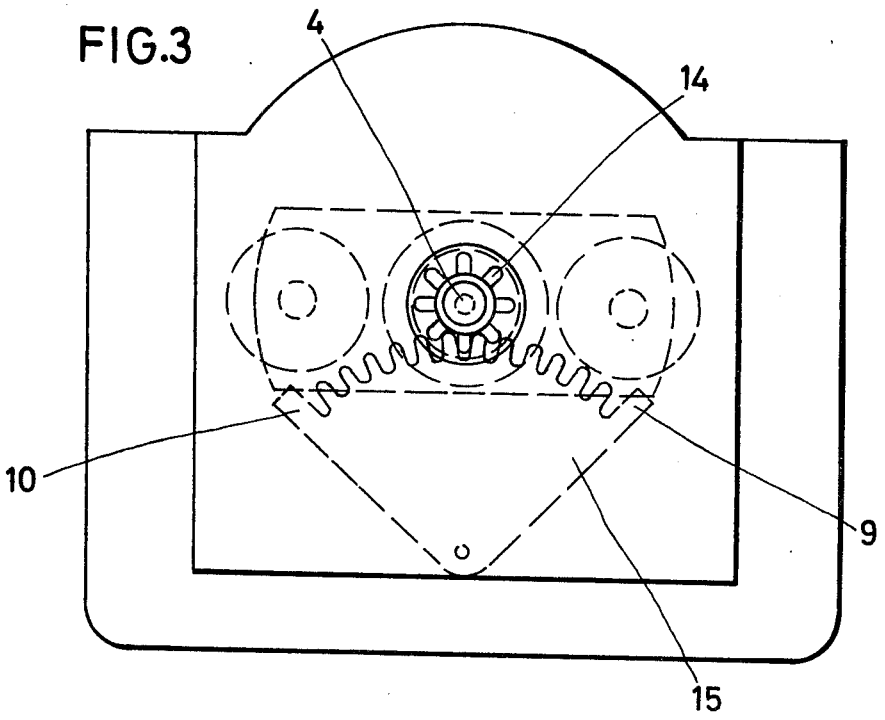
FIG. 3 is a diagramatic plan view of a second embodiment.

FIG. 2 illustrates the mode of operation of the apparatus of FIG. 1 for limiting the arc of oscillation of the spindle 4. FIG. 2 illustrates the stop position after the rotor spindle 4 has rotated to the maximum clockwise extent. Here, the stop finger 1 is up against the dog 6 on the housing 5, while the dog 7 of the rotor disc 3 is simultaneously in contact with the stop finger 1 so that no further clockwise rotation is possible. With the anticlockwise rotation which now commences, first of all rotor disc 3 and stop finger 1 rotate together until the finger 1 strikes the opposite side of the dog 6. Then the rotor disc 3 continues to rotate on its own until the dog 7 strikes the other side, shown in FIG. 2, of the finger 1. This results in a total arc of the spindle 4 of oscillation of about 650°. Because the pendulum only executes an arc of oscillation of about 400° however, when operating, the stop finger 1 works itself into a position in which, with each half oscillation, it is then moved through about 30°. This means that the friction losses introduced by this limitation of the oscillation, are very small. FIG. 3 illustrates a further embodiment. Such a clock is shown in Applicants U.S. application for patent Ser. No. 453,358 filed Mar. 21, 1974 now U.S. Pat. No. 3,924,401. Here, a toothed drive pinion 14 fixedly mounted upon the spindle 4 rotates with the spindle 4 and meshes with a toothed sector 15 carrying stops 9 and 10 at its two ends. The drive pinion 14 meshes with the toothed sector 15 and continuously drives it. As soon as the toothed pinion 14 contacts one of the two stops 10 or 9, motion in that direction is stopped and the pendulum swings back again. The relative number of teeth on the pinion 14 and sector 15 is chosen so as to provide the required maximum oscillation which will normally be greater than 360°.

Figure 4:
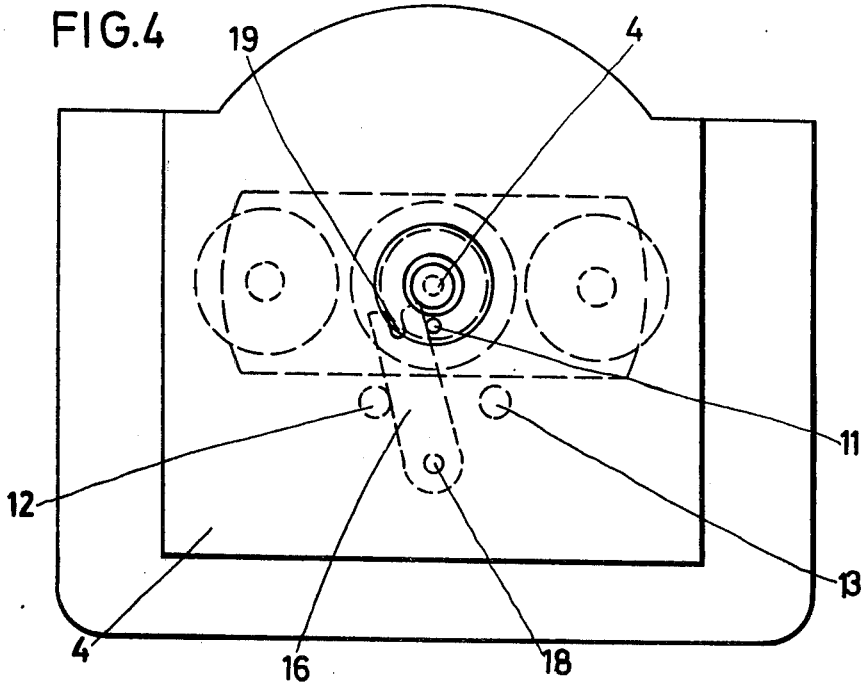
FIG. 4 is a diagramatic view of a third embodiment.

FIG. 4 illustrates another embodiment. Here once again the position of the parts after a rotation to the maximum clockwise extent, has been shown. A drive pin 11 mounted to rotate with the spindle 4 but arranged off-axis strikes a fork 16 which can pivot about its point of suspension 18 and whose rotary motion is limited by the two stops 12 and 13. With the anticlockwise rotation which now takes place, the drive pin 11 moves into the mouth 19 of the fork 16 and moves the latter up to the stop 12 on the housing 5. The spindle 4 continues to swing until the drive pin 11 strikes the back side of the fork 16.

I claim:

1. In a pendulum clock having a torsion pendulum, drive means for driving the torsion pendulum comprising a housing, a spindle for said pendulum, being rotatably mounted in and extending from said housing, drive means in said housing connected to and capable of rotating said spindle in alternate directions, a spiral spring connected to said housing and said spindle providing a restoring force to said spindle, stop means capable of limiting the extent of rotation of said spindle, at least one bearing supporting said spindle, a rotor disc being carried by said spindle, and said stop means including a stop finger being freely mounted on said spindle between said bearing and said rotor disc and two stops being positioned respectively on said rotor disc and said housing for engagement by said stop finger.

2. In a pendulum clock having a torsion pendulum, drive means for driving the torsion pendulum comprising a housing, a spindle for said pendulum, being rotatably mounted in and extending from said housing, drive means in said housing being connected to and capable of rotating said spindle in alternate directions, a spiral spring being connected to said housing and said spindle providing a restoring force to said spindle, stop means capable of limiting the extend of rotation of said spindle, and said stop means including means for limiting the arc of rotation of said spindle to a predetermined value greater than 360°.

* * * * *